US007494352B2

(12) United States Patent
Furio et al.

(10) Patent No.: US 7,494,352 B2
(45) Date of Patent: Feb. 24, 2009

(54) ELECTRICAL CONNECTOR PLUG

(75) Inventors: Miguel Furio, Chaville (FR); Yves Petronin, Montgeroult (FR); Thierry Corriou, Ecquevilly (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 11/943,697

(22) Filed: Nov. 21, 2007

(65) Prior Publication Data

US 2008/0139023 A1 Jun. 12, 2008

(30) Foreign Application Priority Data

Dec. 11, 2006 (FR) ..... 06 55426

(51) Int. Cl.
*H01R 13/62* (2006.01)

(52) U.S. Cl. ..... 439/157; 439/372

(58) Field of Classification Search ..... 439/157, 439/372

See application file for complete search history.

(56) References Cited

U.S. PATENT DOCUMENTS 5,174,785 A * 12/1992 Endo et al. ..... 439/489
6,142,787 A * 11/2000 Ikesugi ..... 439/15
6,354,164 B1 * 3/2002 Megason et al. ..... 74/109
6,561,699 B1 5/2003 De Marchi
6,955,550 B2 * 10/2005 Schlack ..... 439/160
7,066,746 B1 * 6/2006 Togami et al. ..... 439/157
2003/0194900 A1 10/2003 Lee
2008/0139023 A1 * 6/2008 Furio et al. ..... 439/152

FOREIGN PATENT DOCUMENTS

EP 0646992 A1 4/1995
EP 1115178 A2 7/2001

* cited by examiner

*Primary Examiner*—James Harvey
(74) *Attorney, Agent, or Firm*—Barley Snyder LLC

(57) ABSTRACT

An electrical connector plug includes a plug body and a lever. The plug body mates with a socket. The lever is rotatably mounted on the plug body. The lever has a pair of socket locking members arranged on opposite sides of the plug body and a pair of elastic blades arranged on opposite sides of the plug body. The socket locking members are movable between a locked position and an unlocked position. The blades bear against the plug body and bias the socket locking member permanently into the locked position. The lever further includes a base having a pair of arms extending there from. The arms are arranged on opposite sides of the plug body and rotatably mount the lever on the plug body. The blades are connected to the base through an extension extending there between.

16 Claims, 8 Drawing Sheets

ELECTRICAL CONNECTOR PLUG

CROSS-REFERENCE TO RELATED APPLICATIONS

This application claims the benefit of the filing date under 35 U.S.C. § 119(a)-(d) of French Patent Application No. 0655426, filed Dec. 11, 2006.

FIELD OF THE INVENTION

The present invention relates to an electrical connector plug comprising a plug body and a lever wherein the lever is rotatably mounted on the plug body and has at least one socket locking member and at least one elastic blade that biases the socket locking member permanently into the locked position.

BACKGROUND

In the technical field of connectors, particularly in the field of electrical connector plugs, it is necessary to provide a locking device between the connector and a mating socket to prevent disconnection there between as a result of environmental conditions, for example, vibrations, that occur where the connection is made. It is important that the locking device be able to be connected and disconnected quickly and reliably in fields where there are frequent connections and disconnections and, in particular, on removable elements.

SUMMARY

It is therefore an object of the electrical plug connector to provide disconnections and connections which are both fast and reliable in fields where there are frequent connections and disconnections and, in particular, on removable elements.

This and other objects are further achieved by an electrical plug connector comprising a plug body and a lever. The plug body mates with a socket. A lever is rotatably mounted on the plug body. The lever has at least one socket locking member and at least one elastic blade. The socket locking member is movable between a locked position and an unlocked position. The blade bears against the plug body and biases the socket locking member permanently into the locked position.

This and other objects are further achieved by an electrical plug connector comprising a plug body and a lever. The plug body mates with a socket. The lever is rotatably mounted on the plug body. The lever has a pair of socket locking members arranged on opposite sides of the plug body and a pair of elastic blades arranged on opposite sides of the plug body. The socket locking members are movable between a locked position and an unlocked position. The blades bear against the plug body and bias the socket locking member permanently into the locked position. The lever further includes a base having a pair of arms extending there from. The arms are arranged on opposite sides of the plug body and rotatably mount the lever on the plug body. The blades are connected to the base through an extension extending there between.

DETAILED DESCRIPTION OF THE EMBODIMENT(S)

Figure 1:
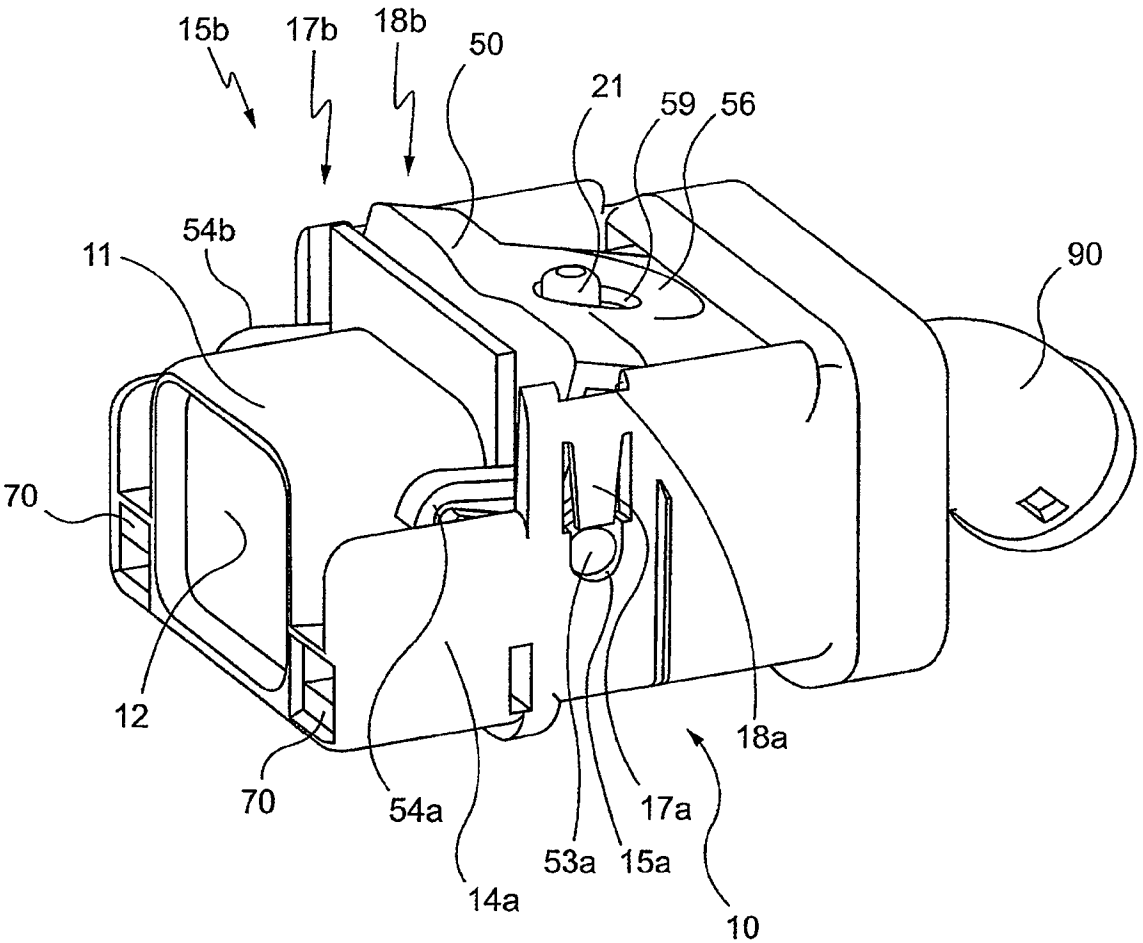
FIG. 1 is a perspective view of an electrical connector plug according to an embodiment of the present invention shown in an unlocked position.
Figure 2:
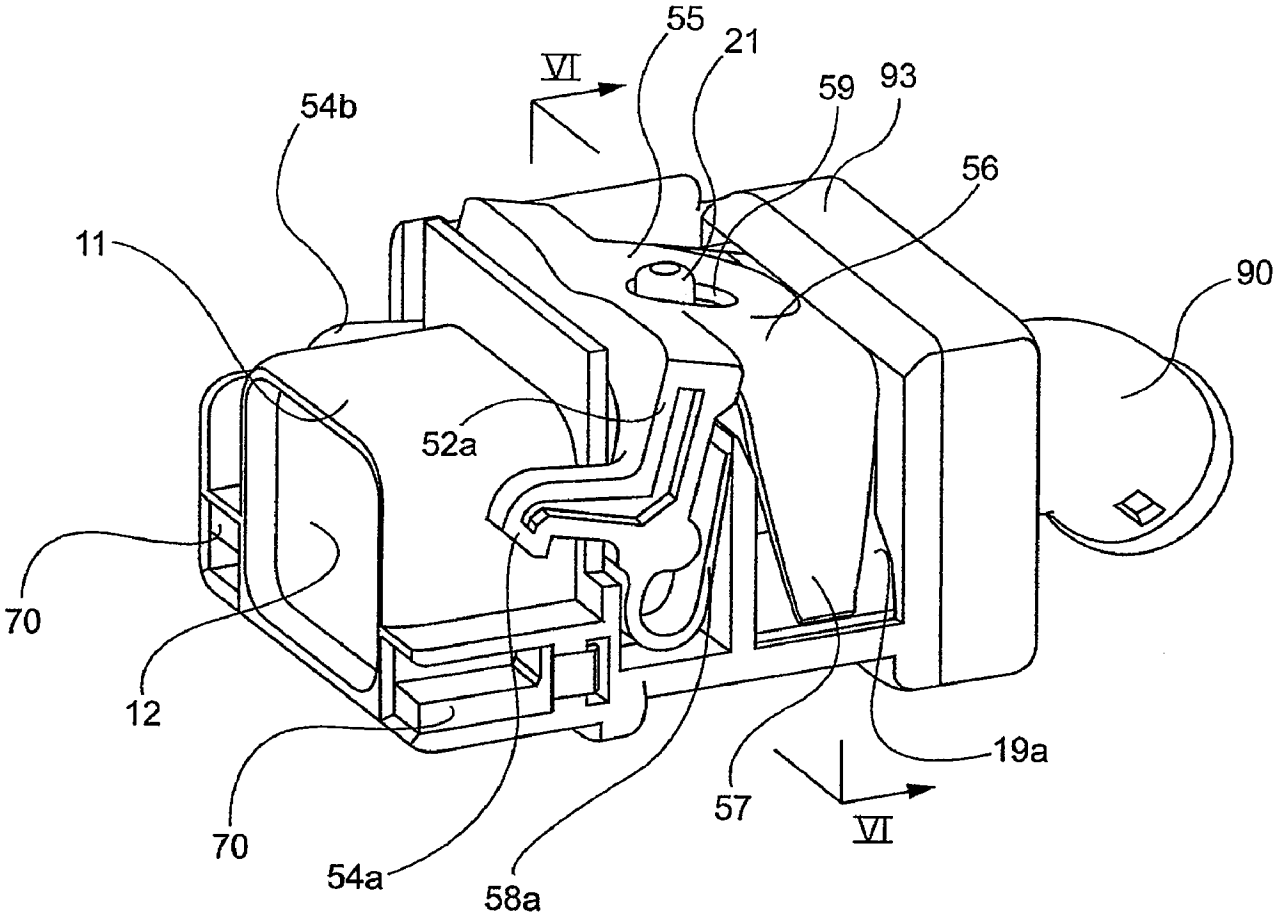
FIG. 2 is a perspective view of the electrical connector plug of FIG. 1 shown without a protective wall in the unlocked position.
Figure 3:
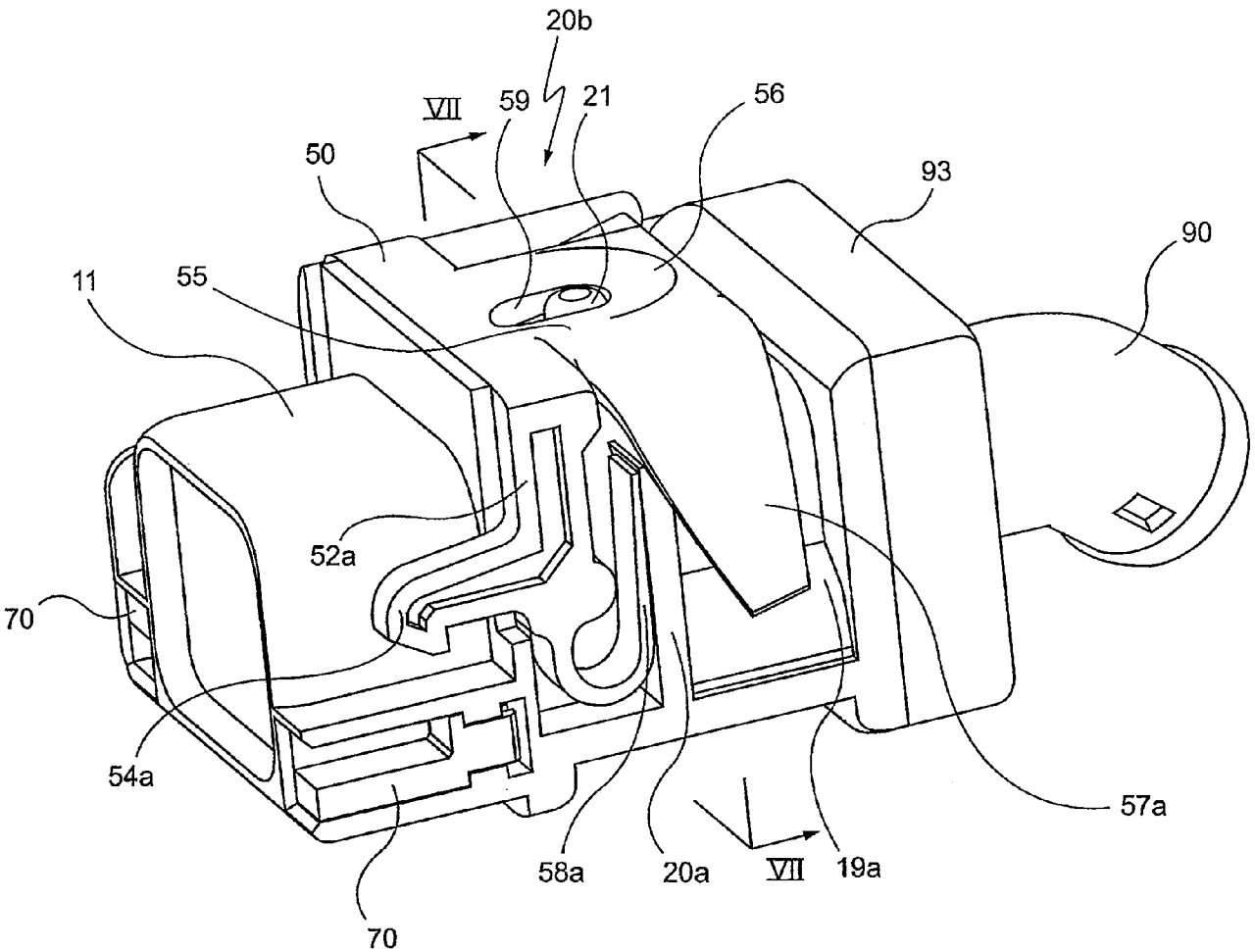
FIG. 3 is a perspective view of the electrical connector plug of FIG. 1 shown without a protective wall in the locked position.
Figure 6:
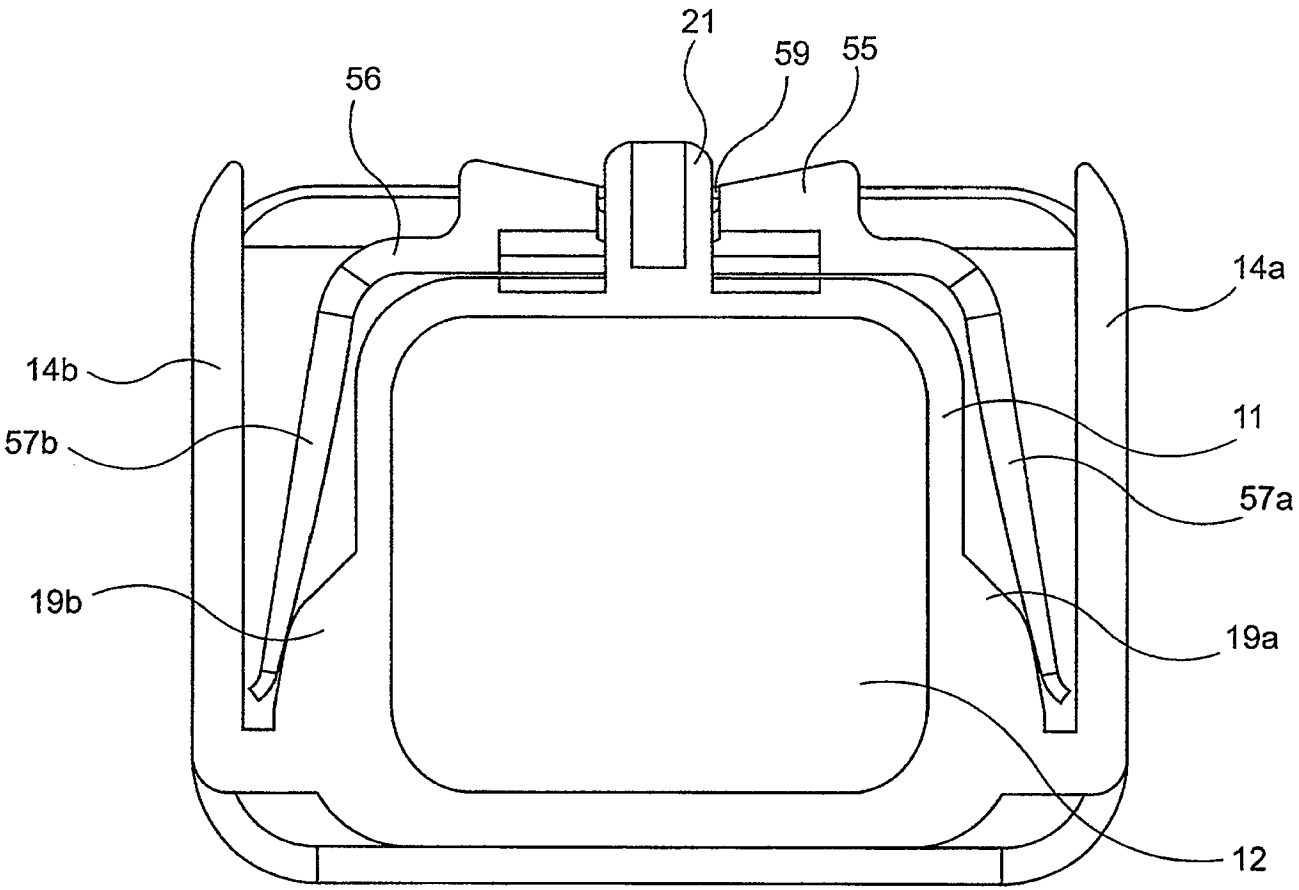
FIG. 6 is a sectional view taken along line VI-VI of FIG. 2.
Figure 8:
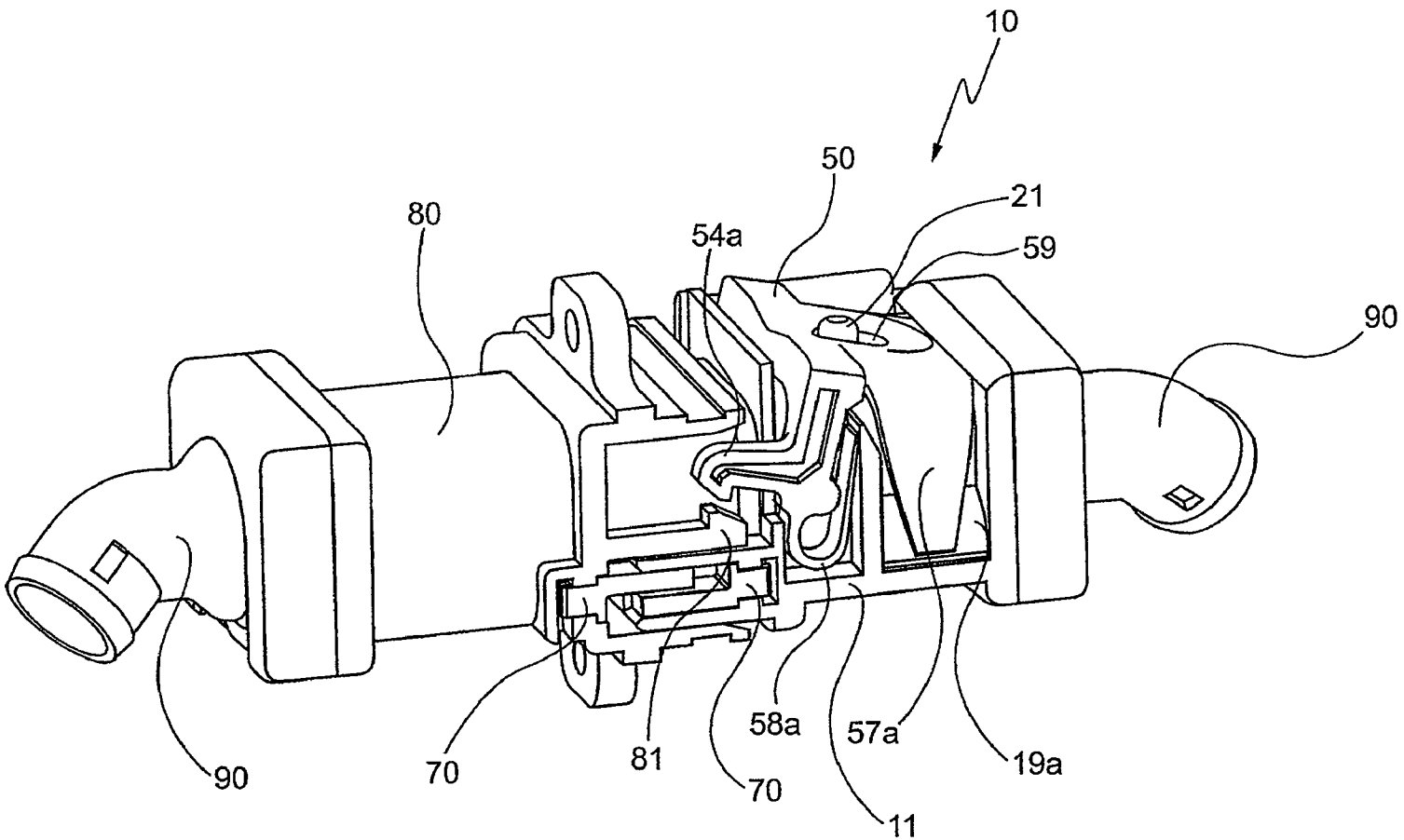
FIG. 8 is a perspective partial cut-away view of the electrical connector plug during connection to a corresponding socket.

FIG. 1 shows an electrical connector plug 10 according to an embodiment of the invention. In the illustrated embodiment, the electrical connector plug 10 applies to cable to cable type connections; however, the electrical connector plug 10 can also apply to cable to printed circuit type connections, for example, in an electrical appliance. As shown in FIG. 1, the plug 10 comprises a substantially hollow plug body 11, a clamp or lever 50, and a cable guiding device 90. The plug body 11 has a conductor element receiving passage 12 extending there through that is open on both sides thereof. The conductor element receiving passage 12 may be dimensioned, for example, to receive standard connection elements, such as modular inserts. As shown in FIGS. 1 and 6, on both sides of the plug body 11 are protective walls 14*a*, 14*b*. Cutouts 18*a*, 18*b* are provided on each internal face of the protective walls 14*a*, 14*b*, respectively. Openings 15*a*, 15*b* are provided in the protective walls 14*a*, 14*b*, for example, by drilling a hole there through. A tongue 17*a*, 17*b* is provided in an extension of each of the openings 15*a*, 15*b*, respectively. As shown in FIG. 3, cross-members 20*a*, 20*b* are provided between the plug body 11 and the walls 14*a*, 14*b*. As shown in FIG. 2, keyways 70 are formed in the plug body 11 and are configured to correspond to a key member (not shown) provided on a mating socket 80 (FIG. 8) so as to avoid connection errors among different possible socket configurations. Cam profiles 19*a*, 19*b* and a projection 21 are provided on the plug body 11, as shown in FIG. 6.

Figure 4:
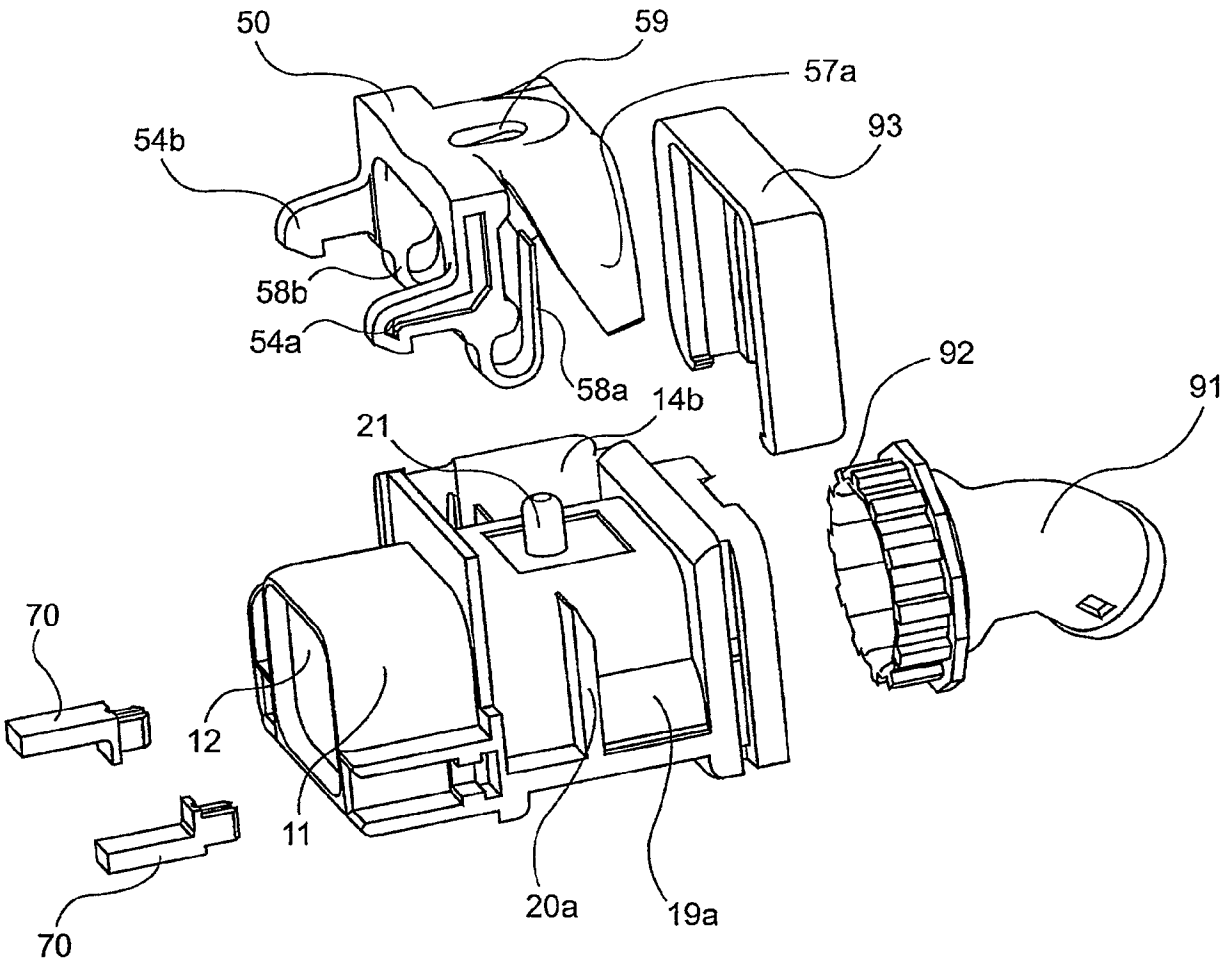
FIG. 4 is an exploded view of the electrical connector plug of FIG. 3.

As shown in FIG. 4, the cable guiding device 90 comprises a substantially curved and movable tube 91. The tube 91 has a base provided with teeth 92. The teeth 92 are configured to cooperate with complementary teeth on the plug body 11 so that the tube 91 may be maintained in a chosen angular position in relation thereto. A clip 93 covers the base of the tube 91 to secure the tube 91 on the plug body 11.

Figure 5:
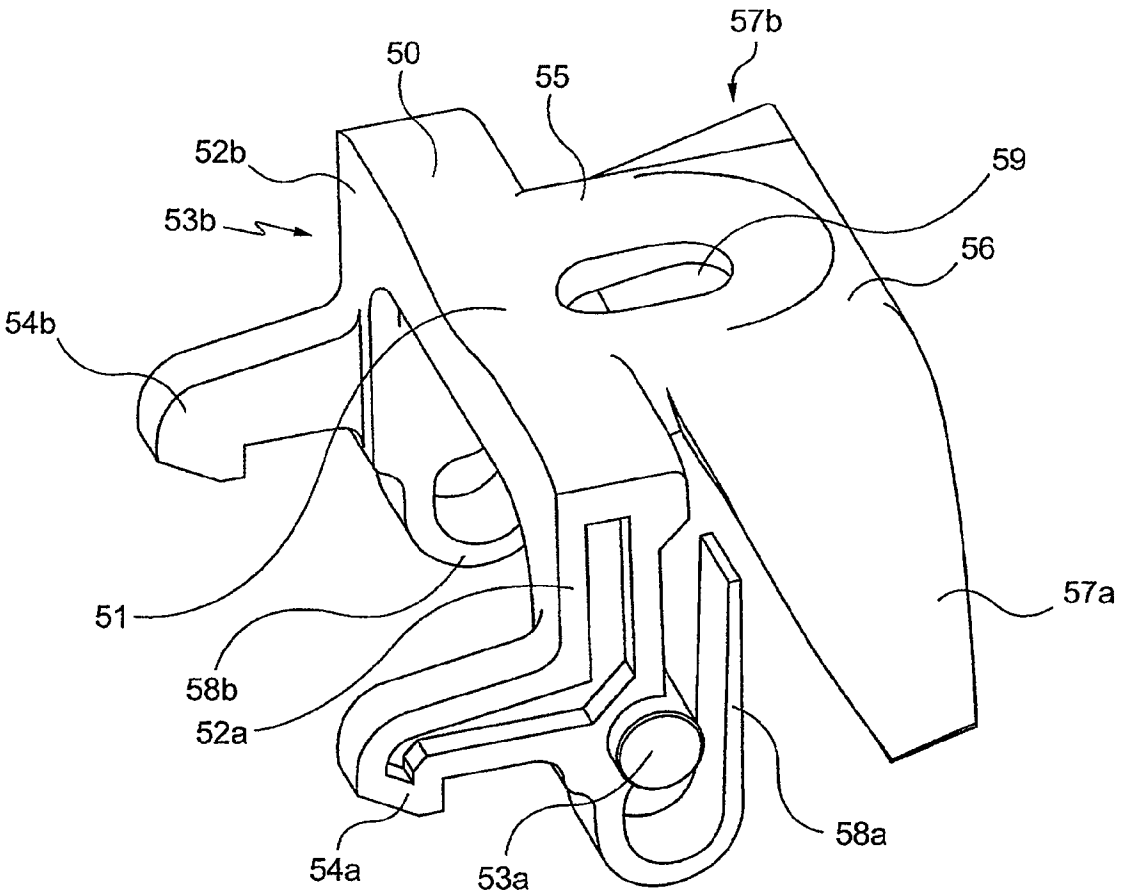
FIG. 5 is a perspective view of a lever of the electrical connector plug.

As shown in FIG. 5, the lever 50 comprises a base 51. Arms 52*a*, 52*b* extend from the base 51. The arms 52*a*, 52*b* are provided with pins 53*a*, 53*b*. Socket locking members 54*a*, 54*b* are integrally formed with the arms 52*a*, 52*b*, respectively, and extend there from in a direction substantially perpendicular to a direction of extension of the arms 52*a*, 52*b*. As shown in FIG. 5, an extension 55 extends from the base 51. The extension 55 is provided with an opening 59. A support 56 is connected to the extension 55 and has blades 57*a*, 57*b* extending there from. The blades 57*a*, 57*b* and the support 56 have a substantially inverted U-shape. Each of the extension arms 52*a*, 52*b* is provided with a second blade 58*a*, 58*b*, respectively, beyond the pins 53*a*, 53*b*. The second blades 58*a*, 58*b* are substantially U-shaped. The blades 57*a*, 57*b*, and the second blades 58*a*, 58*b* are substantially elastic. The lever 50 is substantially symmetrical along a plane substantially perpendicular to an axis formed by the pins 53*a*, 53*b*. The lever 50 may be molded, for example, from high quality carbon fiber reinforced plastic, which provides high stiffness thereto. Because the socket locking members 54*a*, 54*b*, the blades 57*a*, 57*b*, and the second blades 58*a*, 58*b* may be molded integrally with the lever 50, the lever 50 is particularly economical to manufacture.

As shown in FIG. 3, the lever 50 is rotatably mounted on the plug body 11. The blades 57*a*, 57*b* and the support 56, which has a substantially inverted U-shape, is disposed substantially around the plug body 11 so that the opening 59 is received on the projection 21 on the plug body 11. The pins 53*a*, 53*b* are rotationally supported by the openings 15*a*, 15*b* in the protective walls 14*a*, 14*b*, respectively. The cutouts 18*a*, 18*b* in the protective walls 14*a*, 14*b* facilitate installation of the pins 53*a*, 53*b* into the openings 15*a*, 15*b*, respectively. Each of the blades 57*a*, 57*b* cooperates with one of the cam profiles 19*a*, 19*b* provided on the plug body 11. The second blades 58*a*, 58*b* are supported by the cross-members 20*a*, 20*b* on the plug body 11. The lever 50 can be actuated from an outside in order to control the movement of the socket locking members 54*a*, 54*b* between an unlocked position shown in FIGS. 1-2 and 6 and a locked position shown in FIGS. 3 and 7. In the locked position, the socket locking members 54*a*, 54*b* cooperate with notches 81 on the socket 80 (FIG. 8) to lock the electrical plug connector 10 thereon once a connection there between is established.

Figure 7:
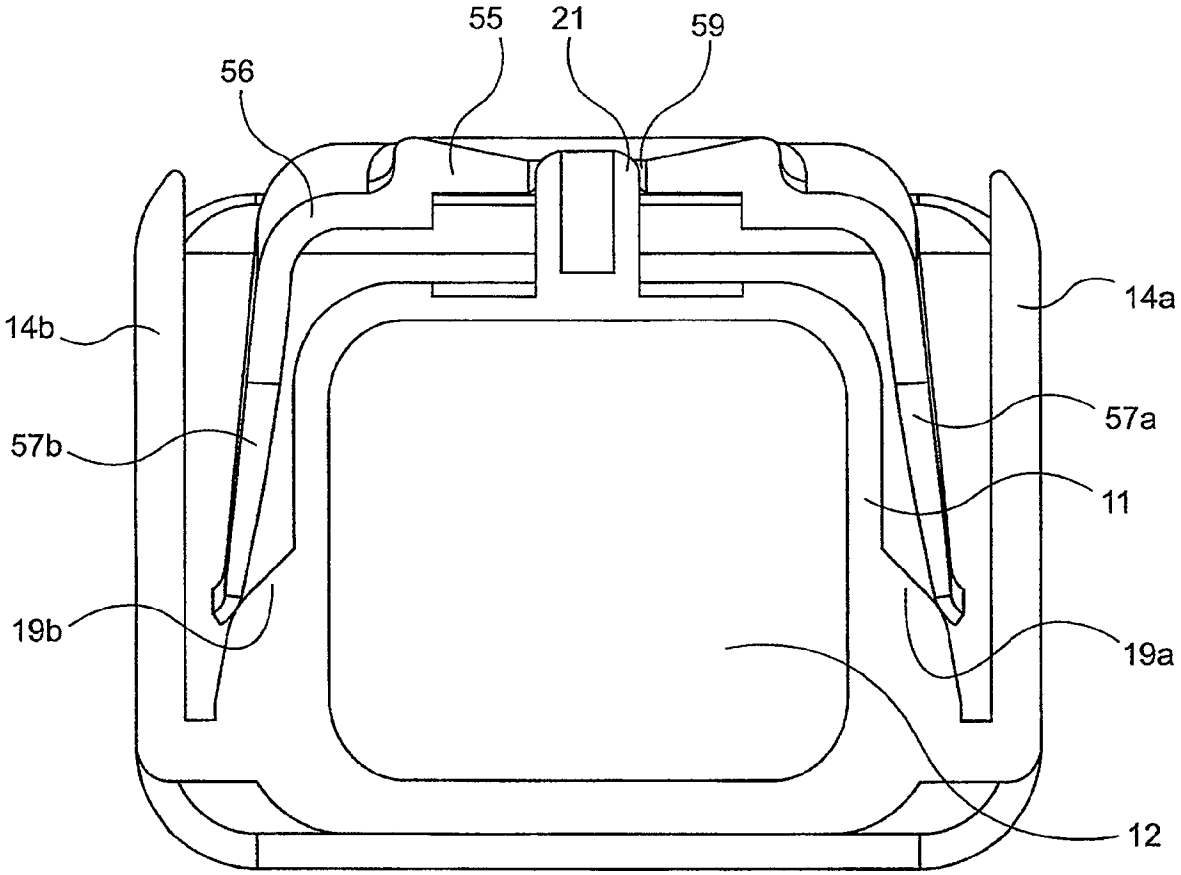
FIG. 7 is a sectional view taken along line VII-VII plane of FIG. 3.

As shown in FIG. 3, the blades 57*a*, 57*b* and the support 56 form a spring that biases the socket locking members 54*a*, 54*b* into the locked position through the extension 55, which transfers a return and biasing force to the lever 50. This spring effect is achieved by the elasticity of the substantially U-shaped structure of the support 56 and the blades 57*a*, 57*b*. Specifically, the blades 57*a*, 57*b* and the cam profiles 19*a*, 19*b* are configured and adapted so that the blades 57*a*, 57*b* are biased into the locked position on assembly, as shown in FIGS. 3 and 7. When the lever 50 is displaced into the unlocked position, the displacement of the lever 50 causes the support 56 to move downwards and the blades 57*a*, 57*b* to move away from each other, as shown in FIG. 6. In this way, the forces generated by the blades 57*a*, 57*b* are substantially exerted in a direction of rotation of the lever 50. Consequently, due to the interaction between the extension 55 and the lever 50, the biasing of the blades 57*a*, 57*b*, as shown in FIGS. 3 and 7, acts as a return force on the socket locking members 54*a*, 54*b*, so that the socket locking members 54*a*, 54*b* move to and are biased into the locked position. As shown in FIG. 3, the second blades 58*a*, 58*b* are supported on the cross-members 20*a*, 20*b*, so that the second blades 58*a*, 58*b* exercise a return force on the lever 50 in a direction substantially perpendicular to an axis of rotation thereof. Due to the interaction between the second blades 58*a*, 58*b* and the pins 53*a*, 53*b*, respectively, the second blades 58*a*, 58*b* applies a return force on the lever 50 and thereby moves the socket locking members 54*a*, 54*b* to the locked position.

Therefore, in the unlocked position shown in FIGS. 1-2 and 6, the blades 57*a*, 57*b* and the second blades 58*a*, 58*b*, which form return springs, exercise higher return forces on the socket locking members 54*a*, 54*b* than in the locked position shown in FIGS. 3 and 7. In other words, in the locked position, the return force exercised by the blades 57*a*, 57*b* is relatively weak and return force exercised by the second blades 58*a*, 58*b* is negligible or nonexistent. However, in the unlocked position, the return forces exercised by the blades 57*a*, 57*b* and the second blades 58*a*, 58*b* are relatively high, since the blades 57*a*, 57*b* and the second blades 58*a*, 58*b* are urged from their rest position and their return forces accumulate.

In practice, when a user begins to rotate the lever 50 in order to disconnect the electrical connector plug 10 from the socket 80, the user encounters sufficiently high return forces from the blades 57*a*, 57*b* and the second blades 58*a*, 58*b*. The force required to rotate the lever from the locked position to the unlocked position remains relatively stable due to the design of the cam profiles 19*a*, 19*b*. However, near the unlocked position, the second blades 58*a*, 58*b* increase the force required to achieve the unlocked position thereby sending a tactile signal to the user that the unlocked position is imminent. Additionally, when the lever 50 is in the unlocked position, the projection 21 protrudes from the opening 59 in the support 56, thus giving the user a tactile signal that the lever 50 is no longer in the locked position. This is advantageous in "hidden" applications where the user does not have direct visual contact with the socket 80 and the electrical connector plug 10 at the moment of connection there between. The electrical connector plug 10 can therefore be advantageously connected and disconnected without tools and with one hand.

The symmetrical disposition of the socket locking members 54*a*, 54*b* allows a uniform distribution of the locking forces on either side of the plug body 11 and contributes, in association with the return force provided by the lever 50, to ensuring good resistance to connection vibrations created by the electrical connector plug 10. Furthermore, the second blades 58*a*, 58*b* prevent jamming of the blades 57*a*, 57*b* in the unlocked position, which might be caused by a less favorable application angle and the high amount of friction that is exerted between the cam profiles 19*a*, 19*b* and the deviated internal surfaces of the blades 57*a*, 57*b*, respectively. Moreover, as shown in FIGS. 6-7, because the support 56 comprises the blades 57*a*, 57*b* and the protection walls 14*a*, 14*b* comprise the cam profiles 19*a*, 19*b*, the lever 50 is relatively compact so that the passage 12 available for the conductor elements to be connected is remarkably large in relation to the total space of the electrical connector plug 10. Thus, the stresses on the blades 57*a*, 57*b* and the second blades 58*a*, 58*b* remain within acceptable limits and the total dimensions remain small, whilst integrating the locking and unlocking functions, as well as the return and biasing functions of the socket locking members 54*a*, 54*b*.

Additionally, a seal (not shown) designed to cooperate with the socket 80 may be fitted at an end of the plug body 11. The symmetrical disposition of the socket locking members 54*a*, 54*b* allows a good distribution of tightening forces on the seal (not shown) and thus contributes to good general sealing of the electrical connector plug 10.

The foregoing illustrates some of the possibilities for practicing the invention. For example, the dimensions of the lever 50, the cam profiles 19*a*, 19*b*, the shape of the blades 57*a*, 57*b*, and/or the plug body 11 may be varied in order to modify the return forces on the socket locking members 54*a*, 54*b* in the locked and unlocked positions, as well as between the locked and unlocked positions. Additionally, a substantially V-shaped spring may provided on the base 51 of the lever 50, between the base 51 of the lever 50 and the plug body 11, so as to increase the return and biasing forces in the locked position and thus to adapt the electrical connector plug 10 to applications having specific functional or ergonomic requirements. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector plug, comprising:

a plug body that mates with a socket;

a lever rotatably mounted on the plug body, the lever having at least one socket locking member and at least one elastic blade, the socket locking member being movable between a locked position and an unlocked position, the blade bearing against the plug body and biasing the socket locking member permanently into the locked position; and wherein the lever includes at least one elastic second blade bearing against a cross-member on the plug body, the cross-member biasing the socket locking member toward the locked position when the locking member is in the unlocked position.

2. The electrical connector plug of claim 1, wherein the plug body has a conductor element receiving passage extending there through.

3. An electrical connector plug, comprising:

a plug body that mates with a socket;

a lever rotatably mounted on the plug body, the lever having a pair of socket locking members arranged on opposite sides of the plug body and a pair of elastic blades arranged on opposite sides of the plug body, the socket locking members being movable between a locked position and an unlocked position, the blades bearing against the plug body and biasing the socket locking member permanently into the locked position;

the lever including a base having a pair of arms extending there from, the arms being arranged on opposite sides of the plug body and rotatably mounting the lever on the plug body, the blades being connected to the base through an extension extending there between; and wherein the lever includes a pair of elastic second blades arranged on opposite sides of the plug body bearing against cross-members on the plug body, the cross-members biasing the socket locking member toward the locked position when the locking member is in the unlocked position.

4. The electrical connector plug of claim 1, wherein the second blade is substantially U-shaped.

5. The electrical connector plug of claim 1, wherein the lever includes a base having arms extending there from, the arms being arranged on opposite sides of the plug body and rotatably mounting the lever on the plug body.

6. The electrical connector plug of claim 1, wherein the blade bears against a cam profile on the plug body, the cam profile biasing the socket locking member permanently into the locked position.

7. The electrical connector plug of claim 1, wherein the lever is substantially symmetrical.

8. The electrical connector plug of claim 1, wherein the lever includes at least one pin that rotatably mounts the lever on the plug body.

9. The electrical connector plug of claim 1, wherein the lever includes at least one opening that is received in a projection on the plug body, the projection being fully received in the opening when the lever is in the unlocked position.

10. The electrical connector plug of claim 3, wherein the lever includes at least one opening that is received in a projection on the plug body, the projection being fully received in the opening when the lever is in the unlocked position.

11. The electrical connector plug of claim 3, wherein the plug body has a conductor element receiving passage extending there through.

12. The electrical connector plug of claim 3, wherein the lever includes at least one pin that rotatably mounts the lever on the plug body.

13. The electrical connector plug of claim 3, wherein the second blades are formed on the arms of the lever.

14. The electrical connector plug of claim 3, wherein the second blades are substantially U-shaped.

15. The electrical connector plug of claim 3, wherein the blades bear against cam profiles on the plug body, the cam profiles biasing the socket locking member into the locked position.

16. The electrical connector plug of claim 3, wherein the lever is substantially symmetrical.

* * * * *